US007661932B2

(12) United States Patent
El-Sayed et al.

(10) Patent No.: US 7,661,932 B2
(45) Date of Patent: Feb. 16, 2010

(54) PRESSURE EXCHANGE APPARATUS

(75) Inventors: Essam E. F. El-Sayed, Ancaster (CA); Mahmoud Abdel-Jawad, Bordeaux (FR); Ali Al-Odwani, Kuwait (KW)

(73) Assignee: Kuwait Institute for Scientific Research, Safat (KW)

( * ) Notice: Subject to any disclaimer, the term of this patent is extended or adjusted under 35 U.S.C. 154(b) by 630 days.

(21) Appl. No.: 10/838,198

(22) Filed: May 5, 2004

(65) Prior Publication Data

US 2005/0249619 A1 Nov. 10, 2005

(51) Int. Cl.
*F04F 99/00* (2009.01)

(52) U.S. Cl. ..... 417/64

(58) Field of Classification Search ..... 417/64, 417/339, 392, 225; 91/483
See application file for complete search history.

(56) References Cited

U.S. PATENT DOCUMENTS 2,675,173 A 4/1954 Jendrassik
2,836,346 A * 5/1958 Jendrassik ..... 417/64
2,968,435 A * 1/1961 Jendrassik ..... 417/64
3,145,909 A 8/1964 Gardiner
3,234,736 A * 2/1966 Spalding ..... 60/39.45
3,431,747 A * 3/1969 Hashemi et al. ..... 417/64
3,641,881 A * 2/1972 Hashemi ..... 417/225
4,360,316 A * 11/1982 Rahnke ..... 417/64
4,887,942 A 12/1989 Hauge
5,338,158 A 8/1994 Hauge

FOREIGN PATENT DOCUMENTS

WO WO 91/06781 5/1991

* cited by examiner

*Primary Examiner*—Devon C Kramer
*Assistant Examiner*—Peter J Bertheaud
(74) *Attorney, Agent, or Firm*—Lowe Hauptman Ham & Berner, LLP

(57) ABSTRACT

A pressure exchange apparatus includes a main section having a plurality of internal chambers and a piston disposed in each of the chambers. The apparatus also includes a pair of fluid distributor assemblies fixed to the main section and co-axial therewith. Each of the distributors include inlet and outlet ports for communicating with one of the internal chambers and sealingly separated from the other chambers. A pair of dual disk controller assemblies each of which includes a fixed disk and a moveable disk housed in a dual disk holder for directing fluid streams from one of the ports into and out of one of the chambers is also provided.

7 Claims, 10 Drawing Sheets

Low Pressure High Pressure —— Fixed disk ------ Rotating disk

Flow-control sequence resulting from the rotation of the movable disks with respect to the fixed disks.

Low Pressure High Pressure —— Fixed disk ------ Rotating disk

Flow-control sequence resulting from the rotation of the movable disks with respect to the fixed disks.

Low Pressure High Pressure —— Fixed disk ------ Rotating disk

Flow-control sequence resulting from the rotation of the movable disks with respect to the fixed disks.

Low Pressure High Pressure —— Fixed disk ------ Rotating disk

Flow-control sequence resulting from the rotation of the movable disks with respect to the fixed disks.

Low Pressure High Pressure Fixed disk Rotating disk

Flow-control sequence resulting from the rotation of the movable disks with respect to the fixed disks.

Low Pressure High Pressure —— Fixed disk ------ Rotating disk

Flow-control sequence resulting from the rotation of the movable disks with respect to the fixed disks.

PRESSURE EXCHANGE APPARATUS

FIELD OF THE INVENTION

This invention relates to a pressure exchange apparatus for exchanging hydraulic pressure from a fluid stream at relatively high pressure to a fluid stream at relatively low pressure and more particularly to a pressure exchange apparatus for hydraulic energy recovery by directly transferring the hydraulic pressure energy contained in a pressurized exhaust fluid to a feed fluid in a process that requires pressurization.

BACKGROUND FOR THE INVENTION

An industrial process that requires considerable pressurization of solutions is the desalting of seawater or other relatively highly concentrated saline aqueous solutions using reverse osmosis membrane technology. In this type of process, the saline solution is pressurized, by using a mechanical or electrical driven device, to reach a pressure that exceeds the osmotic pressure of the solution, which is a function of the solutes' concentration. The excess pressure, which is equivalent to the working pressure less the osmotic pressure of the pressurized solution, is the driving force that causes the transport of pure water through the reverse osmosis membrane, thus producing depressurized desalinated water on the other side of the membrane at atmospheric pressure. The transport of pure water through the membrane causes an increase in the solutes' concentration in the pressurized solution to a point that the osmotic pressure becomes too high, thus causing the driving pressure, which effects the transport of pure water across the membrane, to diminish. This requires depressurization and draining of the concentrated solution and replacement of the drained solution with newly pressurized feed solution.

Under steady-state continues operation of a desalination process, a feed solution is continuously pressurized into the reverse osmosis membrane module vessel using an electrically or mechanically driven high pressure pump, and the concentrated exhaust solution is depressurized through a valve, in which case, no useful energy is recovered, or through a turbine, which helps recover a portion of the hydraulic energy contained in the exhaust solution. The economy with which the reverse osmosis desalination process can be practiced is directly dependent upon the efficiency with which the energy input to the process during the pressurization of the feed solution can be recovered from the pressurized exhaust solution after separation of the pure water.

Several devices have been proposed and a few machines are available on the market to recover substantial portions of the energy contained in an exhaust pressurized fluid system. Examples of the available machines are the reverse centrifugal pumps and the hydraulic turbine in which the pressurized exhaust fluid is used to drive the machine, thus generating mechanical energy, which is then utilized to assist and reduce the energy required for driving the main pressurizing device in the process. These engines have reasonable reliability, however, the efficiency with which these machines recover the hydraulic energy contained in the pressurized exhaust fluid is in the range of 60% to 70% and may be, up to about 80%. The actual useful energy, which can then be transferred to the fresh feed fluid that is being pressurized, will be substantially less than the amount of energy recovered by these machines because it has to be transferred through a pumping device.

Other devices that are still in the development stage and not yet widely used commercially are of the type known as flow work exchangers, or pressure exchangers, which can be utilized to simultaneously depressurize the exhaust fluid and pressurize the feed fluid in the process. One type of exchanger is generally based on a piston reciprocating in a cylinder, where, in one stroke, the pressurized exhaust fluid is admitted at one end of the cylinder applying its pressure on one side of the piston causing it to move towards the other end of the cylinder, thus pressurizing the feed fluid that had previously filled the cylinder while, in the return stroke, the feed fluid is admitted at the second end of the cylinder at relatively low pressure causing the piston to move back towards the first end of the cylinder, hence, discharging the exhaust fluid, which had filled the cylinder during the previous stroke, at normal atmospheric pressure. The successive alternation between high and low pressure filling strokes requires rapidly operating valves in each pair of the liquids' inlet and outlet ports into and from the cylinder, respectively, in which the piston reciprocates. Due to the requirement for the inclusion of a piston-cylinder arrangement as well as valves, energy losses may be high. Moreover, there may be practical limitations on the use of rapidly operated valves in handling large volumes of liquids.

Another type of pressure exchanger is based on a cylindrical rotor slidingly moving at its ends and at its circumferential surface against matching surfaces of a stationary structure, i.e., a matching stator. The rotor has longitudinal conduits that are circumferentially spaced from each other and each has an opening located in the sliding end surfaces of the moving rotor. The stator, which is in contact with the rotor, has two matching sealing flat surfaces that slidingly and sealingly engage end surfaces of the cylindrical rotor in which the end openings of the longitudinal conduits are located. The stator further has one pair of fluid inlet passageways extending into it and each opens at one of the sealing surfaces. Another pair of fluid discharge passageways are spaced from the fluid inlet passageways, and also opens at one of the sealing surfaces of the stator. The openings of the longitudinal conduit in the moving rotor and the openings of the passageways in the stator are positioned in their respective surfaces in such a way that the rotor is moved with its end surfaces in which the longitudinal conduits' openings are located in sealing contact with the sealing surfaces of the stator. The openings into the two ends of each longitudinal conduit are periodically brought into communication with a fluid inlet passageway at one end of the longitudinal conduit and fluid discharge passageway at the other end of the longitudinal conduit, and alternately, the position of the fluid inlet and fluid discharge passageways with respect to the ends of the longitudinal conduit are periodically reversed. These types of machines require a substantial amount of energy for moving and constantly maintaining the movement of the large mass of the rotor, and also to overcome the friction, which is caused by the relative motion between the large area of the sealingly sliding surfaces of the rotor against the matching surfaces of the stator. Moreover, a substantial portion of the volume of the longitudinal conduits is a dead volume that is filled with liquid reciprocating between the two ends of the longitudinal conduits separating the incoming liquid from the outgoing liquid to minimize the mixing between the two working liquids.

BRIEF SUMMARY OF THE INVENTION

The present invention provides a new type of pressure exchange apparatus that is particularly suitable as the hydraulic energy recovery part of a high pressure reverse osmosis process for desalting sea water or saline solutions instead of a conventional reverse pump or turbine machine. The pressure exchange apparatus of the present invention is a highly efficient device by which 90% or more of the hydraulic energy contained in the pressurized exhaust fluid is transferred to the feed fluid prior to its pressurization, thus reducing the amount of energy required by the process of pressurization. Furthermore, unlike other pressure exchanger's, the pressure exchange apparatus of the present invention is characterized by having a very small moveable mass with small frictional surface area and involves no external momentum transfer to or from any other fluid streams. Therefore, the apparatus is less vulnerable to break down and/or loss of energy.

In essence, the present invention contemplates a pressure exchange apparatus for exchanging hydraulic pressure from a fluid stream at relatively high pressure to a fluid stream at relatively low pressure. The apparatus includes a main or center section which is preferably in the form of a cylindrical conduit. The main or center section is disposed on a longitudinal axes and defines at least two and preferably four longitudinal internal chambers disposed about the longitudinal axes. A piston is disposed within each of the chambers in slidable and sealing engagement with the walls of the chamber and adapted to move longitudinally within each of the chambers.

The apparatus also includes a pair of fluid distributor assemblies fixed to the main section on opposite sides thereof and preferably coaxial therewith. Each of the fluid distributor assemblies includes an inlet port and an outlet port for communicating with one of the longitudinal internal chambers and sealingly separated from an adjacent chamber. A pair of dual disk controller assemblies each of which includes a fixed disk and a moveable disk are provided for directing a fluid stream from one of the ports into and out of one of the chambers to move the piston and transfer the relatively high pressure fluid stream to the relatively low pressure stream.

In a preferred embodiment of the invention, the pressure exchange apparatus includes a main section or middle structure which is internally and equally divided into four compartments along its longitudinal axis. It is in these compartments that the exchange of pressure between the high pressure fluid and the low pressure fluid occurs. The apparatus also includes a pair of fluid distributor assemblies each of which has at least one inlet port and one outlet port and wherein each port is aligned with an internal chamber while being seated and separated from the other chambers which are similarly aligned with other ports. The main section is co-axially aligned with the fluid distributors at both of its ends so that each of the longitudinal compartments in the main section can be brought into communication with either of the inlet or outlet chambers in the respective fluid distributor by a pair of dual disk controllers. These dual disk controllers are placed co-axially between each of the fluid distributors and the main section. Each of the disk controller assemblies contains a moveable disk having circumferentially arrayed openings, sealingly sliding between a fixed disk and a dual disk holder which have a pair of circumferentially arrayed openings aligned against each of the inlet and outlet chambers in the respective fluid distributor. As a moveable disk in one of the dual disk controller assemblies is circularly moved around its axis at a certain moment, at least one of the circumferentially arrayed openings in the movable disk is brought into registration with one of the circumferentially arrayed pair of matching openings in the respective fixed disk and dual disk holder of the said dual disk controller assembly, thus allowing either an inlet or outlet chamber in the respective fluid distributor to communicate with the respective longitudinal compartment in the main section. Simultaneously, the movable disk in the other dual disk controller assembly is similarly moved circularly around the same common axis. This brings at least one of its circumferentially arrayed openings into registration with a pair of matching openings in the fixed disk and dual disk holder of the second dual disk controller assembly, which is in line with the openings in the first dual disk controller assembly, hence allowing inversely the outlet or inlet chamber in the other fluid distributor to communicate with the longitudinal compartment in the main section, but from the other end.

Concurrently, another circumferentially arrayed opening in the movable disk in the first dual disk controller assembly is brought into registration with a different pair of matching openings of the circumferentially arrayed openings in the fixed disk and the dual disk holder of the said dual disk controller assembly, thus converse to the first event, allowing either an opposite outlet or inlet chamber in the respective fluid distributor to communicate with another longitudinal compartment in the main section opposite to the first compartment. Also concurrently, but on the other side of the main section, another circumferentially arrayed opening in the moveable disk of the other dual disk controller assembly is brought into registration with a pair of matching openings in the fixed disk and dual disk holder, which is in line with the pair of matching openings in the first dual disk controller assembly, hence communication either an inlet or outlet chamber in the second fluid distributor with the second longitudinal compartment in the main section, converse to the communication on the other side of the main section. The inlet and outlet ports of one fluid distributor are, arbitrarily, used to admit the exhaust pressurized fluid and to drain the exhaust fluid at normal atmospheric or relatively low pressure, respectively, while the inlet and outlet ports of the other fluid distributor are used to admit the relatively low pressure fresh feed fluid and to discharge the pressurized fresh feed fluid, respectively. Therefore, the two fluid distributors shall be positioned relative to each other, separated by the main section and the dual disk controller assemblies, in a reverse position so that each inlet port in a given fluid distributor is aligned with an outlet port in the other fluid distributor, and similarly, each outlet port in the said fluid distributor is aligned with an inlet port in the other fluid distributor.

As the moveable disks in the dual disk controller assemblies continue to concurrently move circularly around their common axis, these events of registration between the circumferentially arrayed openings in the moveable disks and the circumferentially arrayed pairs of matching openings in the fixed disks and dual disk holders of the respective dual disk controller assemblies will be cyclically repeated, thus subjecting each longitudinal compartment in the main section to alternately communicate with inlet and outlet or outlet and inlet ports of the exhaust and fresh feed fluids continuously.

DESCRIPTION OF THE PREFERRED EMBODIMENTS OF THE INVENTION

Figure 1:
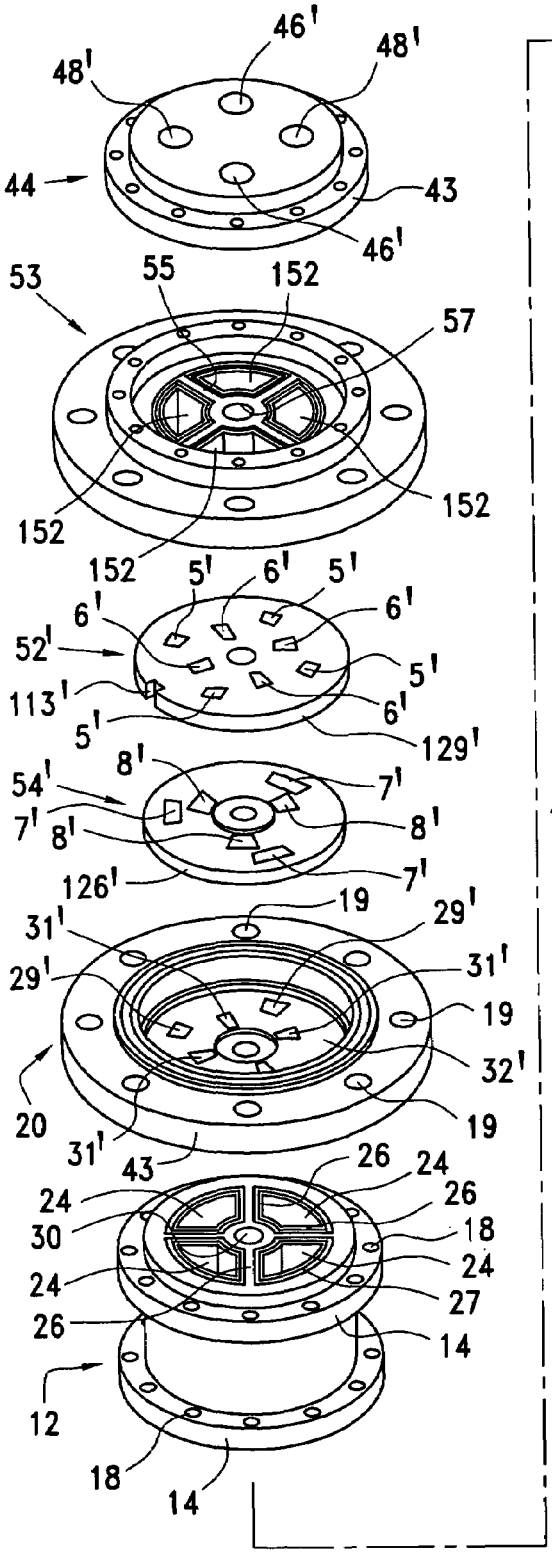
FIG. 1 is an isometric view illustrating the overall assembly of a pressure exchanger in accordance with the present invention.
Figure 1A:
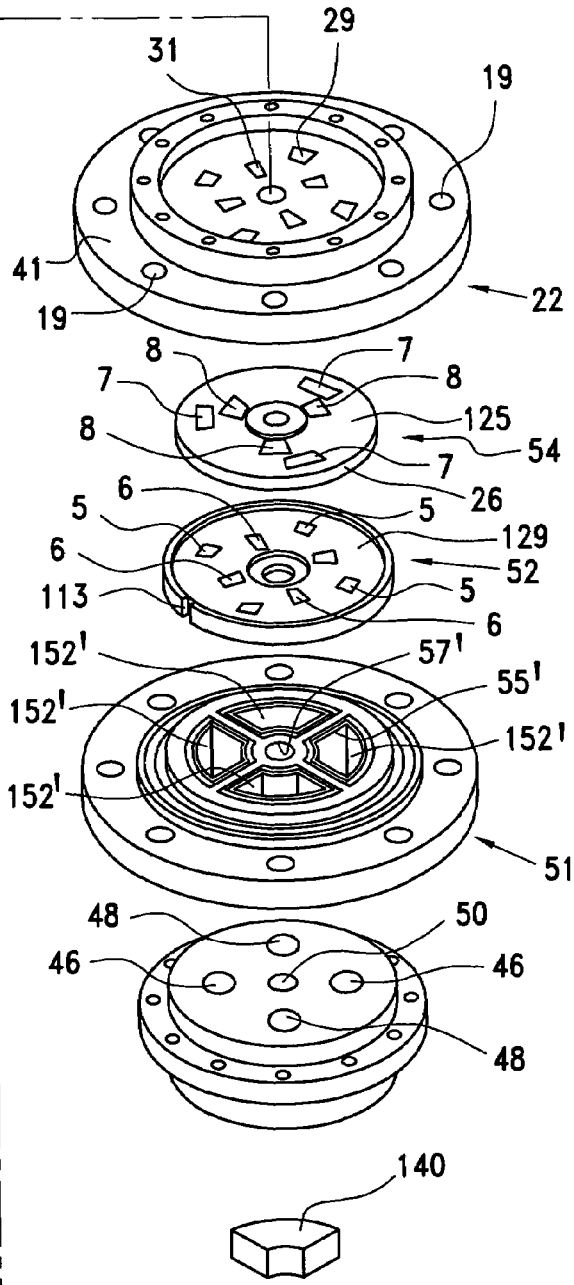
FIG. 1*a* is an isometric view of a piston as incorporated in the invention.
Figure 1B:
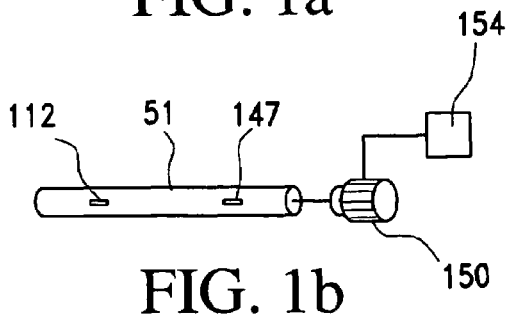
FIG. 1*b* is a schematic isometric view of a shaft, motor and control as incorporated in the present invention.

The invention will now be described in connection with the accompanying drawings wherein like reference numerals have been used to designate like parts.

Figure 2:
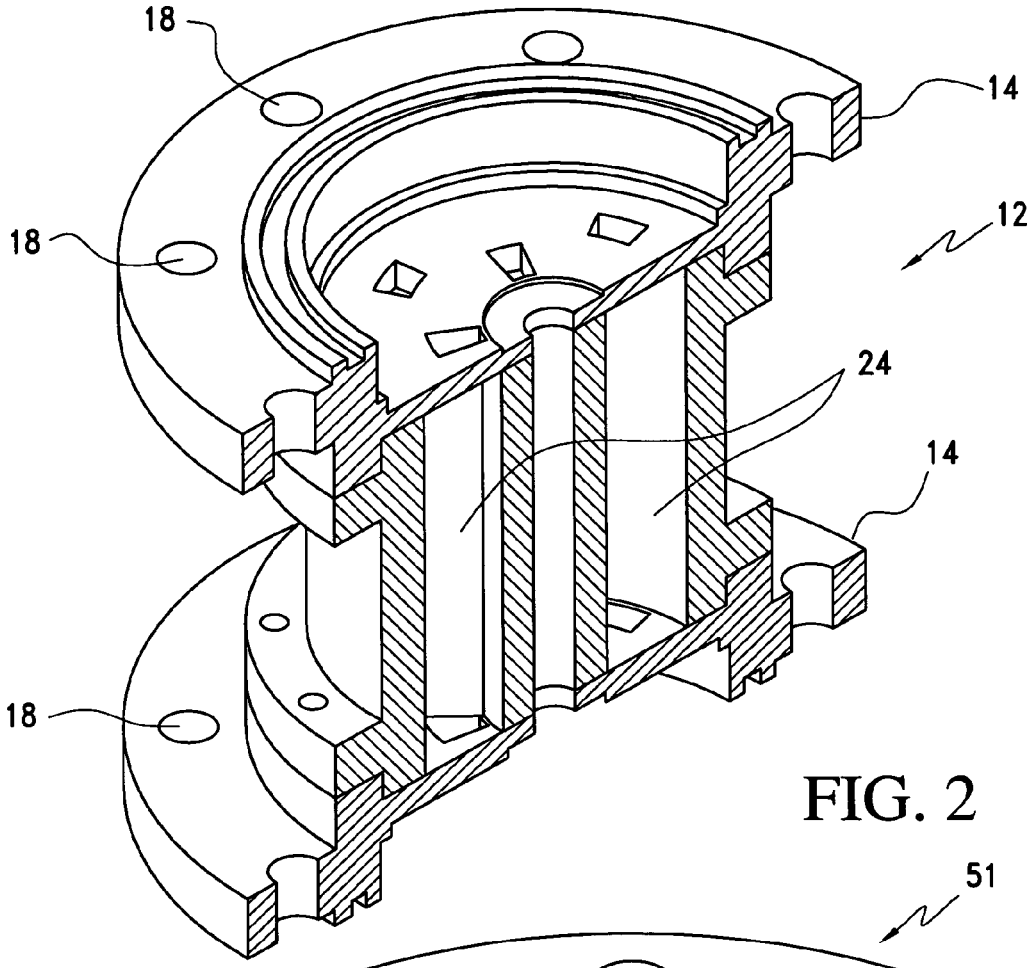
FIG. 2 is a partially cutaway isometric view of the main or center section of a pressure exchanger in accordance with the invention.

As illustrated in FIGS. 1 and 2, the pressure exchange apparatus in accordance with the present invention comprises a conduit or main section 12 having two end flanges 14. The two end flanges 14 are attached to, or preferably, an integral part of the main section 12 and are attached to a pair of dual disk holders 20, 22 by means of bolts, bolt holes 18 and internally threaded bolt holes 19.

The main section 12 also defines four longitudinally extending internal compartments or chambers 24 which have a generally pie shaped cross section and which are isolated from one another by radially extending walls or partitions 26. The main section 12 also includes a housing cylinder or central casing which defines a bearing surface or passage way 30 for receiving a shaft therein.

Four sliding blocks or pistons 40 each have a cross-sectional shape which is essentially the same as the internal cross-sectional shape of the internal chambers 24. The two ends of each of the longitudinal compartments 24 are sealed to prevent any undesirable flow therebetween by O-rings which are housed in O-ring seats 27 which are formed in the main section 12 and sealed by the bolts which press the flanges 14 against the dual disk holders 20 and 22. The sliding blocks or pistons 40 then move along the longitudinal chambers 24 in sliding and sealing engagement with the walls of the chambers.

Each of the dual disk holders 20 and 22 include circumferential arrayed openings 29 and 31 and 29' and 31' respectively which are arrayed over two different mean radii and equal angular intervals and are aligned with the longitudinal chambers 24 so that each opposite pair of the openings 29 and 29', 31 and 31' are in line with one of the longitudinal compartments or chambers 24. The mean radius of each set of openings 29, 31 and 29' and 31' are equal. Furthermore, the inner radius of the outer opening 29 and 29' should be at least equal to or preferably larger than the outer radius of the inner openings 31 and 31'. Both sets of openings 29, 31 and 29' and 31' are equally spaced over the circumference of the mean radius of each set and are of equal open area.

Figure 3:
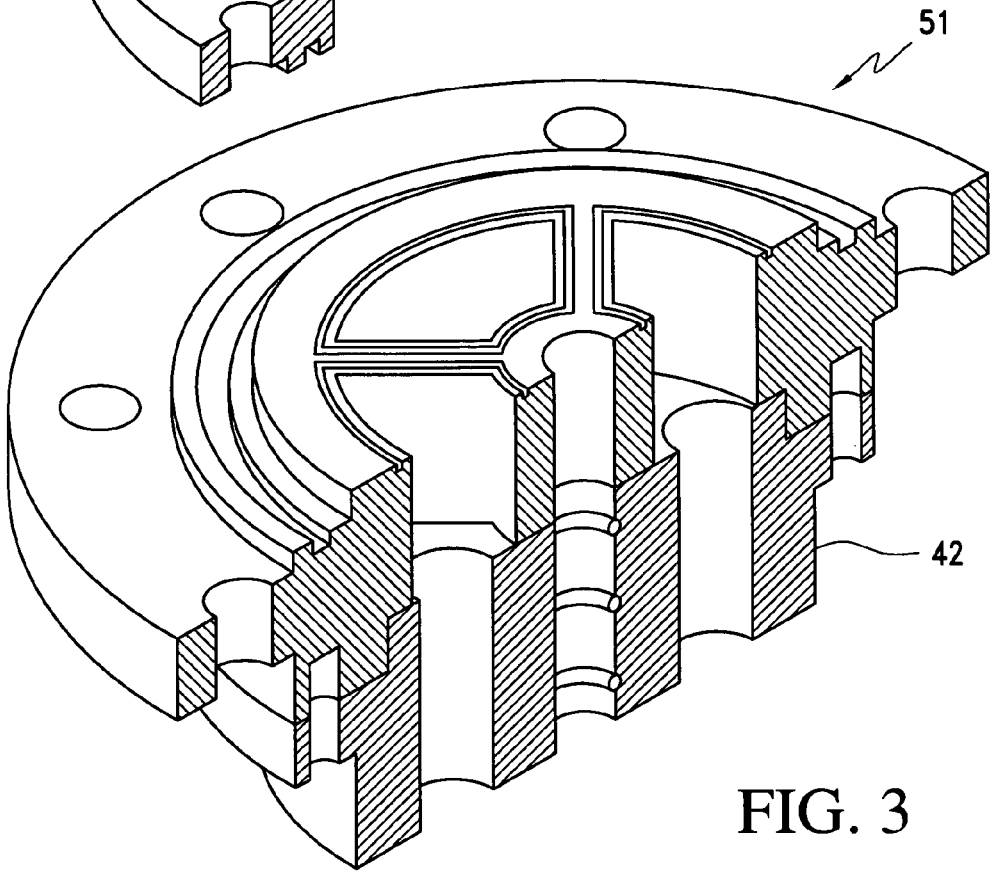
FIG. 3 is a partially cutaway isometric view of the high and low-pressure exhaust fluid waste flow streams distributor.
Figure 4:
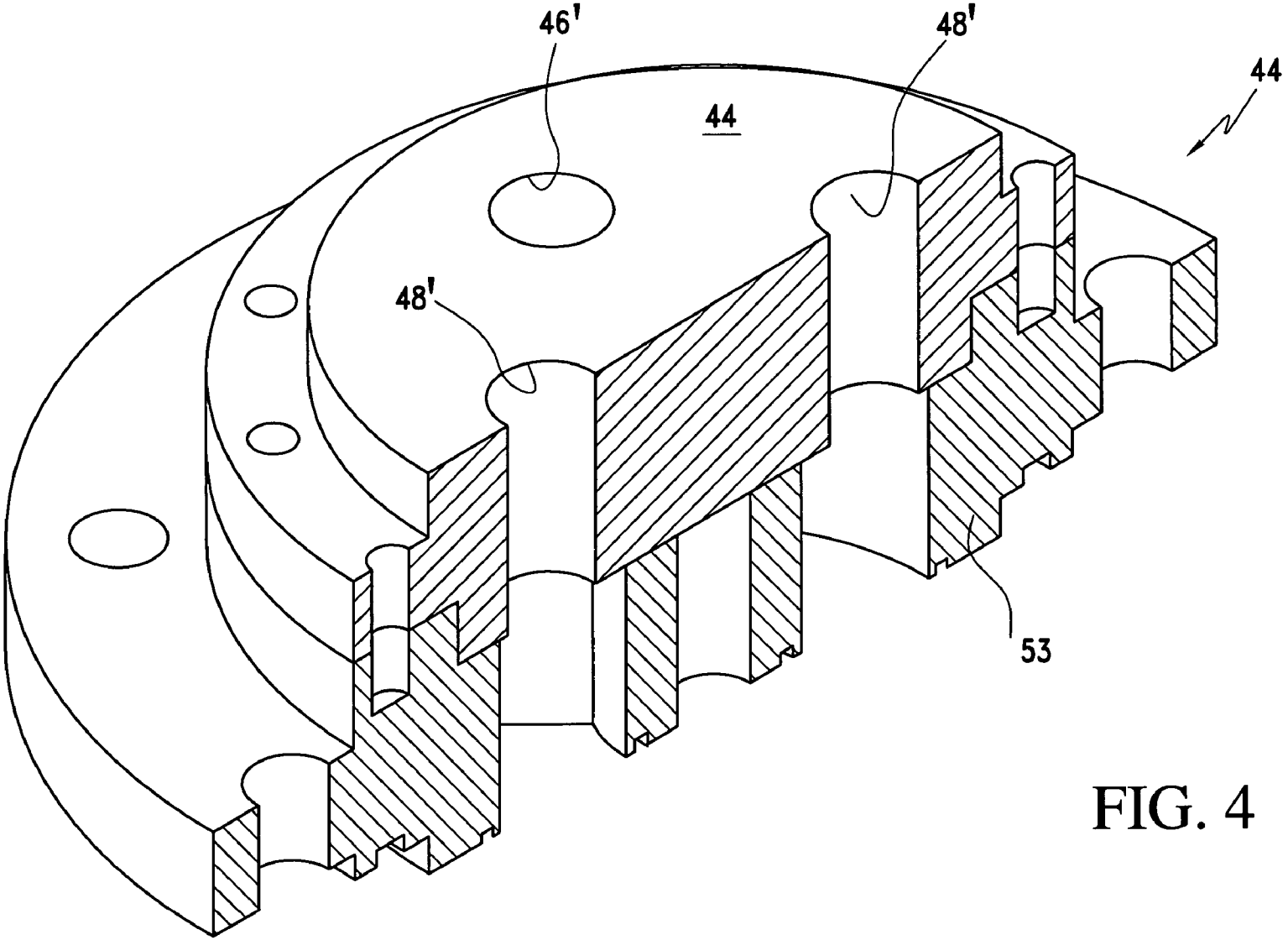
FIG. 4 is a partially cutaway isometric view of the high and low pressure fresh feed fluid flow streams distributor.

FIGS. 1, 3 and 4 show two fluid distributor assemblies which include inlet/outlet structures 42 and 44 and fluid distributors 51 and 53. The inlet/outlet structure 42 includes a pair of fluid inlets 46 and a pair of fluid outlets 48 and flanges 43. The structure 42 also includes a shaft bearing hole or passageway 50 which is adapted to receive a shaft 151 which passes through the passageway 30. The inlet/outlet structure 44 is essentially identical to the structure 42 and includes a pair of fluid inlets 46' and outlets 48'. The shaft bearing hole is arbitrarily omitted from the inlet/outlet structure 44.

The apparatus also includes a pair of fluid distributors 51 and 53 each of which includes four fluid distributing chambers 152, 152' which are of equal cross-sectional area and separated from each other by radial partitions 55, 55'. These radial partitions also provide support to an axial shaft housing which in turn contains shaft bearing holes 57, 57'.

Each of the inlet/outlet structures 42 and 44 are bolted to the respective fluid distributors 51 and 53, respectively, by means of bolts, bolt holes 118, and internally threaded bolt holes 119. The fluid distributing chambers 152, 152' are well sealed to prevent any undesirable flow therebetween by O-ring seals disposed in O-ring seats 127 and sealed by the bolts which press the inlet/outlet structures 42 and 44 against the fluid distributors 51 and 53, respectively.

Each of the fluid inlets 46, 46' and each of the fluid outlets 48 and 48' in the inlet/outlet structures 42 and 44 are aligned with one of the fluid distributing channels 152, 152' contained in fluid distributors 51 and 53. The dual disk holders 20 and 22 are disposed between the main section 12 and fluid distributors 51 and 53 and are positioned with respect to one another so that each of the fluid distributing chambers 152, 152' can communicate with two longitudinal chambers 24 in a main section 12 through openings 29 and 31 in the dual disk holders 20 and 22.

Figure 5:
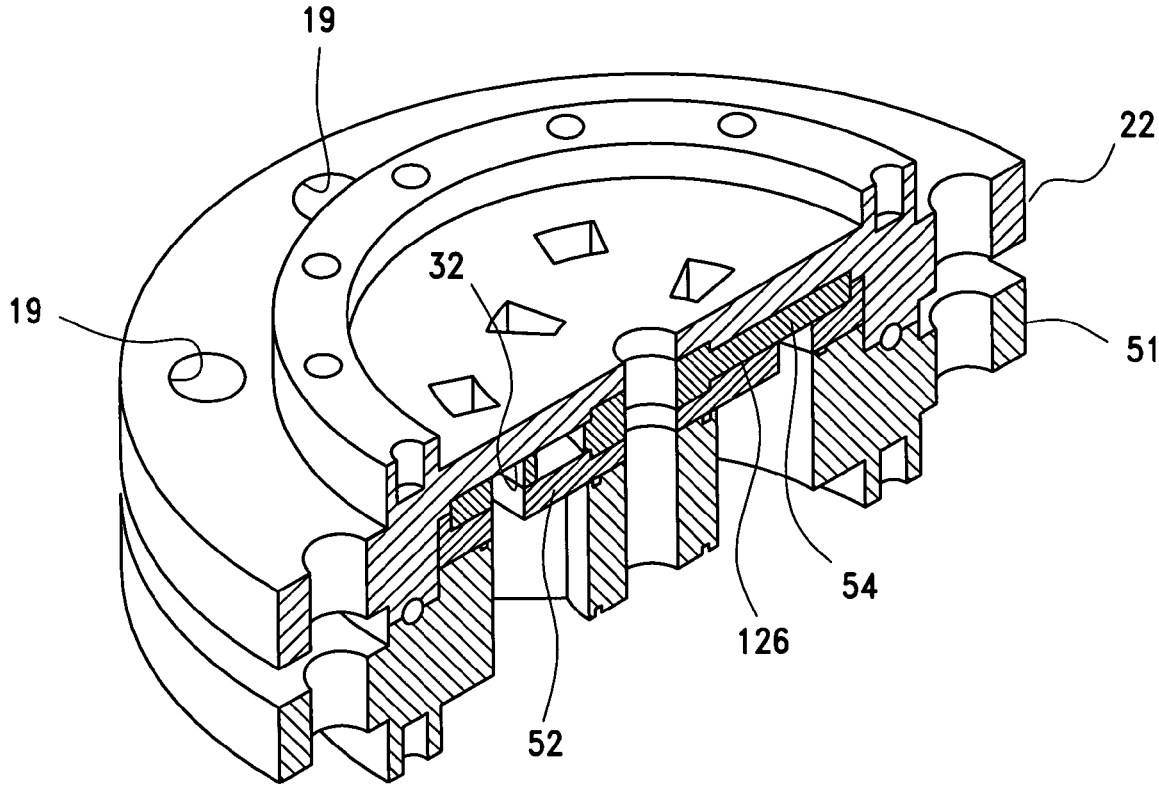
FIG. 5 is a partially cutaway isometric view of a controlling disk assembly as incorporated in the present invention.

The fluid inlets 46' in inlet/outlet structure 44 are aligned with fluid outlets 48 in inlet/outlet structure 42 and fluid outlets 48 in inlet/outlet structure 42 are aligned with fluid inlets 46 in inlet/outlet structure 44. Sealing is provided by an O-ring seal. Communication between a fluid distributing chambers 152 and 152' in the fluid distributors 51 and 53 and two adjacent longitudinal chambers 24 in the main section 12 is controlled by the dual disk holders 20 and 22 each of which houses a fixed disk 52, 52' and a moveable disk 54, 54' as shown more clearly in FIGS. 1 and 5.

The fixed disks 52 and 52' have two sets of circumferentially arrayed openings 5, 5' and 6, 6' which are arrayed identically to opening sets 29, 29' and 31, 31' respectively in terms of their respective angular and radial positions. For example, the moveable disks 54, 54' are positioned between the fixed disks 52 and 52' and dual disk holders 20, 22 in such a way that the surfaces 126, 126' in disks 54, 54' sealingly slide against bottom surfaces 129, 129' in fixed disks 52, 52' and surfaces 125, 125' in disks 54, 54' can sealingly slide against bottom surfaces 32 and 32' in the dual disk holders 20, and 22 while the edge surfaces in disks 52, 52' against edge surfaces in the dual disk holders 20 and 22 maintains the moveable disks 54, 54' firmly housed between the fixed disk 52 and 52' and the dual disk holders 20 and 22 without excessive rubbing forces on the sealingly sliding surfaces.

Rotation prevention members 113 and 113' are provided in the fixed disk 52, 52' for mating with corresponding members 114 and 114' (not shown) in dual disk holders 20 and 22 to maintain the fixed disks in position with respect to the housing of the dual disk holders 20 and 22 O-rings seated in surfaces in the fluid distributors 51 and 53 are pressed against the surfaces in the fixed disks 52 and 52' to seal the distributing chambers 152, 152' while allowing communication between the chambers and the longitudinal chambers 24 only through opening sets 5, 5' and 29, 29' or 6, 6' and 31, 31'.

Also, circular O-ring seals seated in surfaces in the fluid distributors 51 and 53 are pressed against the surfaces of the dual disk holders 20 and 22 by means of bolts and bolt holes 91 and 91' in dual disk holders 20 and 22 and bolt holes 91 and 91' in dual disk holders 20 and 22 and bolt holes 92 and 92' in fluid distributors 51 and 53 to guard against any external leakage.

Opening sets 7, 7' and 8, 8' in the moveable disks 54, 54' have the same inner/outer and mean radii as those of opening sets 5 and 6 in the fixed disk 52 and 52' respectively and opening sets 29, 29' and 31, 31 ' in the dual disk holders 20 and 22 respectively'. However, the angular position area and number of openings in the opening sets 7, 7' and 8, 8' are constructed and arranged to provide isolation between any two adjacent openings in opening sets 29, 29' and 31, 31' and are registered with a particular longitudinal compartment 24 in the main section 12 and at the same time provide communications between at least two distributing chambers 152, 152' radially positioned across from each other with their respective longitudinal chambers 24.

A driving shaft 51 which is supported by bearing hole 50 passageways 30, 57, 57' are appropriately sealed by a triple O-ring seals at one end and is driven by means for rotating the shaft such as a motor 150. The speed of the engine is controlled by any suitable speed controller 152 as for example a computer program which is responsive to a flow rate of exhaust fluid. The moveable disks are then rotated by means of keyways 112 and 147 in a conventional manner.

In the apparatus of the invention, exhaust liquid, having relatively high pressure, is admitted arbitrarily for example, through inlet passageways 46 in inlet/outlet structure 42 and at the same time, fresh feed liquid, having relatively low pressure, is admitted through the inlet passageways at the other end of the pressure exchanger, i.e., passageways 46' in inlet/outlet structure 44. Hence, the respective distributing chambers are filled with these two liquids at their respective pressures.

Assuming clockwise rotation of the moveable disks 54, 54', an opening in the opening set 7 in the moveable disk 54 begins registration with a matching opening in the opening set 29 in dual disk holder 22 and a matching opening in opening set 5 in the fixed disk 52 which are in line with the distributing chamber 152' and associated with exhaust liquid inlet passageway 46 in inlet/outlet structure 42 at relatively high pressure. Concurrently, on the other side of the main section 12, the corresponding opening in the opening set 8' in the moveable disk 54' begins registration with a matching opening in the opening set 31' in dual disk holder 20 and a matching opening in opening set 6' in the fixed disk 52' which are in line with the distributing chamber 152 associated with the fresh feed liquid outlet passageway 48' in inlet/outlet structure 44. Hence, the exhaust liquid flows into the respective longitudinal compartment 24 in the main section 12 which has been filled with the fresh feed liquid during a previous cycle. Thus the incoming exhaust liquid displaces the outgoing fresh feed liquid at a relatively high pressure towards the respective distributing chamber 152, leading to the corresponding outlet passageway 48' of the feed liquid on inlet/outlet structure 44.

Concurrently, an opening in the opening set 7' in moveable disk 54', which is not neighboring (i.e., not angularly overlapping with) the aligned opening in opening set 8', begin registration with a matching opening in the opening set 29' in dual disk holder 20 and a matching opening in opening set 5' in the fixed disk 52' which are in line with the distributing chamber 152 associated with the fresh feed liquid inlet passageway 46' in inlet/outlet structure 44 at relatively low pressure. On the other side of the main section 12, the corresponding opening in opening set 8 in the moveable disk 54 begins registration with a matching opening in the opening set 31 in dual disk holder 22 and a matching opening in opening set 6 in the fixed disk 52 which are in line with the distributing chamber 152' associated with the exhaust liquid outlet passageway 48 in inlet/outlet structure 42. Therefore, the feed liquid flows into the respective longitudinal compartment 24 in the main section 12 (which is radially across the longitudinal compartment 24), which has been filled with the exhaust liquid during a previous cycle. This causes the exhaust liquid to flow out at a low pressure towards the respective distributing chamber 152' leading to the corresponding outlet passageway 48 of the exhaust liquid on the inlet/outlet structure 42 at atmospheric pressure. During further rotation of the moveable disks 54, 54' the longitudinal compartment 24, which is now filled with the exhaust liquid is subject to a similar sequence of events, for this case, an opening in opening set 8' is in registration with a matching opening in the opening set 31' in dual disk holders 20 and a matching opening in opening set 6' in the fixed disk 52' which are in line with the distributing chamber 152 and associated with the fresh liquid inlet passageway 46' in the inlet/outlet structure 44, and with the corresponding opening in opening set 7 in registration with a matching opening in the opening set 29 in the dual disk holder 22 and a matching opening in opening set 5 in the fixed disk 52' which are in line with the distributing chamber 152' associated with the exhaust liquid outlet passageway 48' in inlet/outlet structure 42. Therefore, incoming fresh feed liquid displaces the outgoing exhaust liquid at relatively low pressure. Concurrently, the longitudinal compartment 24, which is radially across from the longitudinal compartment that is now filled with the fresh feed liquid is also subject to a similar sequence of events.

When an opening in opening set 7 is in registration with a matching opening in opening set 29 in the dual disk holder 22 and a matching opening in opening set 5 in the fixed disk 52 which are in line with the distributing chamber 152' associated with exhaust liquid inlet passageway 46 in inlet/outlet structure 42, and the corresponding opening in opening set 8' is in registration with the matching opening in opening set 31' in the dual disk holder 20. And the matching opening in opening set 6' in the fixed disk 52' is in line with the distributing chamber 152 associated with the fresh feed liquid outlet passageway 48' in inlet/outlet structure 44. Therefore, incoming exhaust liquid displaces the outgoing fresh feed liquid at the relatively high pressure. During any of these cyclic fillings of a liquid into a particular longitudinal compartment 24, and displacement of the other liquid, the sliding block or piston 40 slides along the inner walls of the longitudinal compartment 24, and acts as a separator between the two working liquids, thus preventing or minimizing undesirable mixing between the two liquids. The time during which the aligned openings in the opening sets 7 or 8 remain in registration with the pairs of matching openings in opening sets 5 and 29 at one end of the main section 12 and 6 and 31 at the other end of the main section 12 should ideally equal the time required for the exhaust liquid to flow in and fill the respective longitudinal compartment 24. The flow of liquid displaces any equivalent volume of the fresh feed liquid at a relatively high pressure, or similarly, equal the time required for the fresh feed liquid to flow in and fill the other respective longitudinal compartment 24, which concurrently displaces an equivalent volume of the exhaust liquid at relatively low or atmospheric pressure. In other words, the rotational speed of the movable disk must be compatible with the flow rate at which each of the two liquids, i.e., exhaust liquid at relatively high pressure, or fresh feed liquid at relatively low pressure, are being admitted into their respective inlets at both ends of the pressure exchanger. Steady-state continuous operation of the pressure exchange machine of the present invention is maintained by the steady rotational movement of the movable disks 54, 54', which is accompanied by continuous steady supply of both liquids through their respective inlet passageways at their respective pressures.

A step-by-step rotation of the movable disks is shown in the diagrammatic representation of the relative positions of the opening sets 7, 7' and 8, 8' in the movable disks 54, 54' with respect to the pairs of matching opening sets 5, 5' and 6, 6' in fixed disks 52, 52', and 29, 29' and 31, 31' in the dual disk holders 20 and 22, as given in FIG. 6 (in this Figure, subscript number identification is used to identify each individual object in the opening sets 5, 5', 6, 6', 7, 7', 8, 8', 29, 29' and 31, 31', distributing chambers 152, 152', or longitudinal chambers 24). At an arbitrary rotational position, such as shown in FIG. 6*a-r* subscript number identifications are used to identify individual objects in the opening sets, distribution chambers or longitudinal chambers. In FIG. 6*a* on the exhaust liquid inlet/outlet side opening $\mathbf{7}_1$ is in registration with openings $\mathbf{5}_1$ and $\mathbf{29}_1$ providing 100% open area, which is open to $\mathbf{152'}_1$ and 24, subject to low pressure, and similarly opening $\mathbf{8}_3$ is in registration with openings $\mathbf{6}_3$, $\mathbf{6}_4$ and $\mathbf{31}_4$ providing 100% open area, which is open to $\mathbf{152}_3$, $\mathbf{152'}_4$ and $\mathbf{24}_3$ subject to high pressure. Concurrently in FIG. 6*a* on the fresh feed inlet/outlet side, opening $\mathbf{8'}_1$ is in registration with openings $\mathbf{6'}_1$ and $\mathbf{31'}_1$, providing 100% open area, which is open to $\mathbf{152}_1$ and $\mathbf{24}_1$ subject to low pressure, and similarly opening $\mathbf{7'}_3$ is in registration with openings $\mathbf{5'}_4$ and $\mathbf{29'}_4$providing 100% open area, which is open to $\mathbf{152}_4$ and $\mathbf{24}_3$ and subject to high pressure. FIG. 6 shows a step by step (at a 7.5° step) sequential relative positioning of these openings for one full cycle, which is repeated every 120° rotation of the movable disks 54, 54'.

Figure 6A:
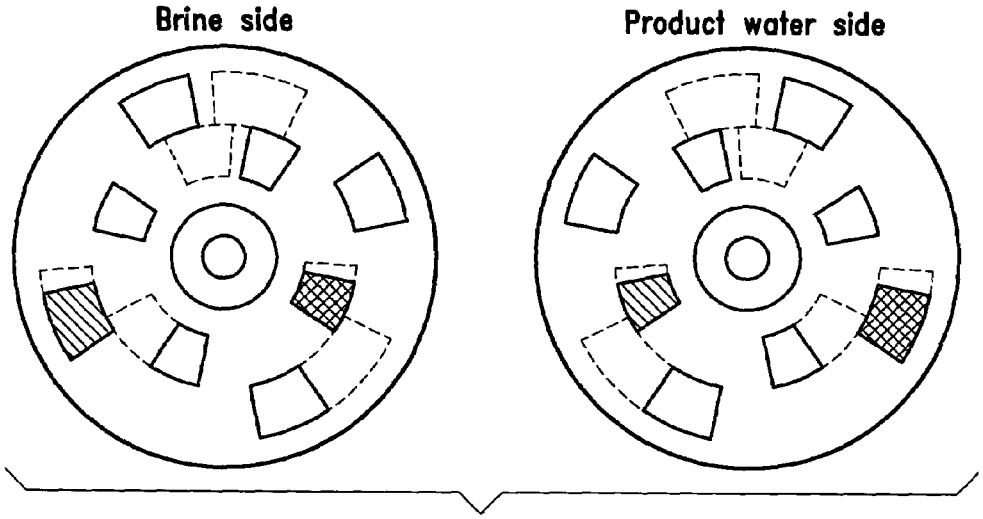
FIG. 6*a*-6*r* are representations of the flow-control sequence resulting from the rotation of the moveable disks with respect to the fixed disks and dual disk holders in accordance with the present invention.
Figure 6B:
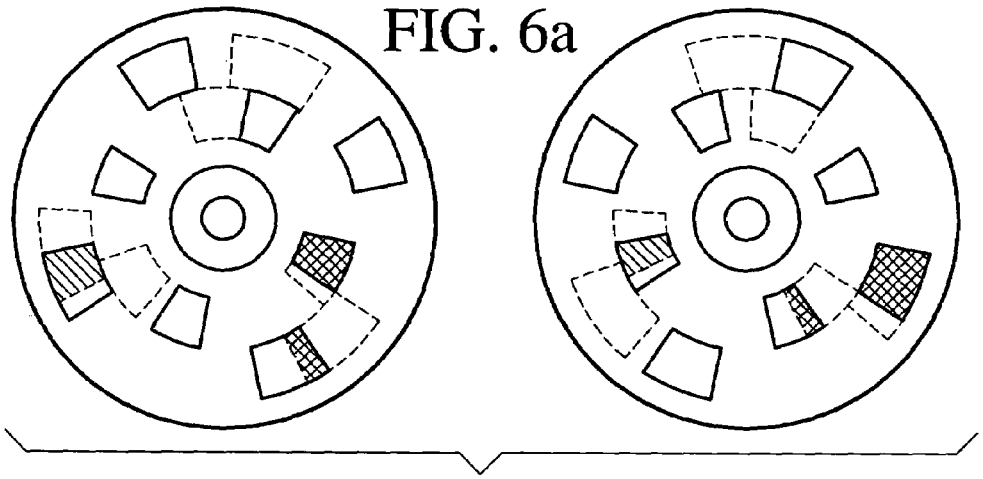
Figure 6C:
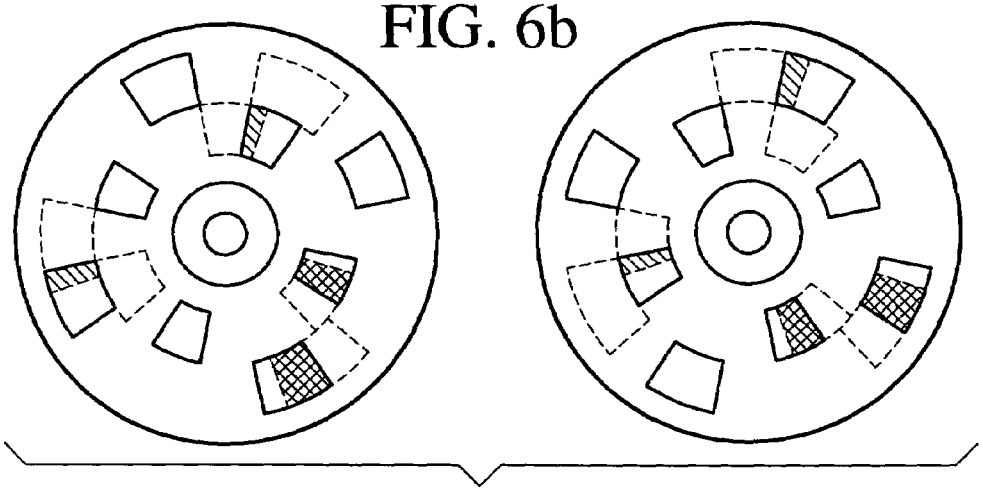
Figure 6D:
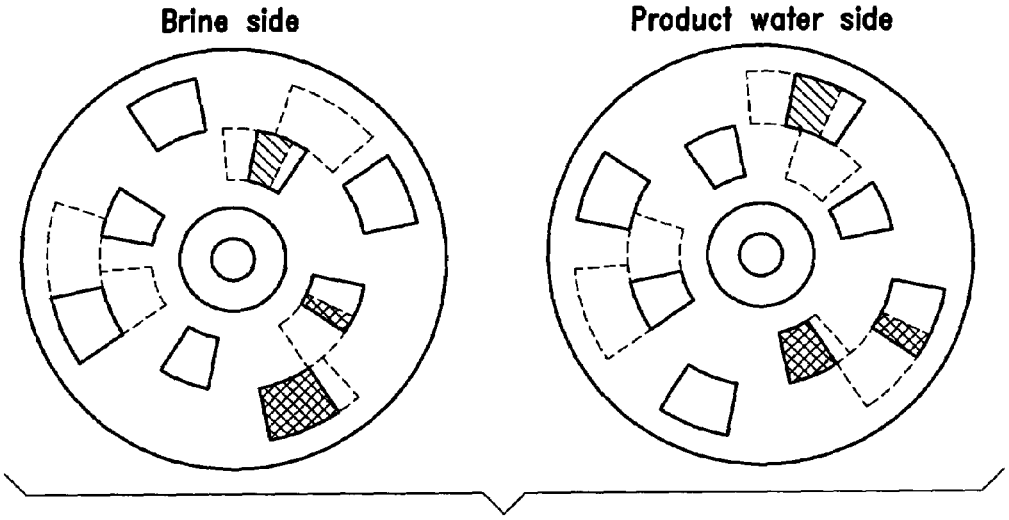
Figure 6E:
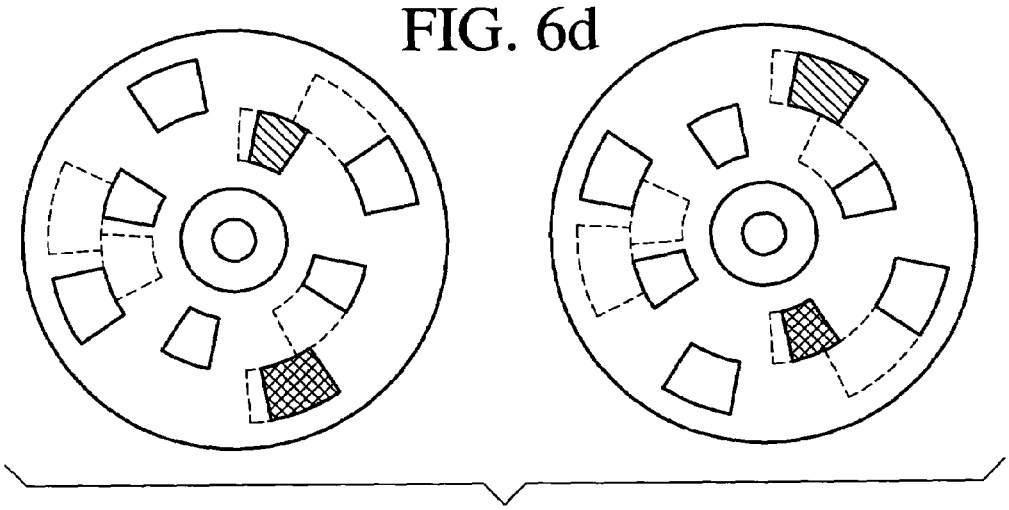
Figure 6F:
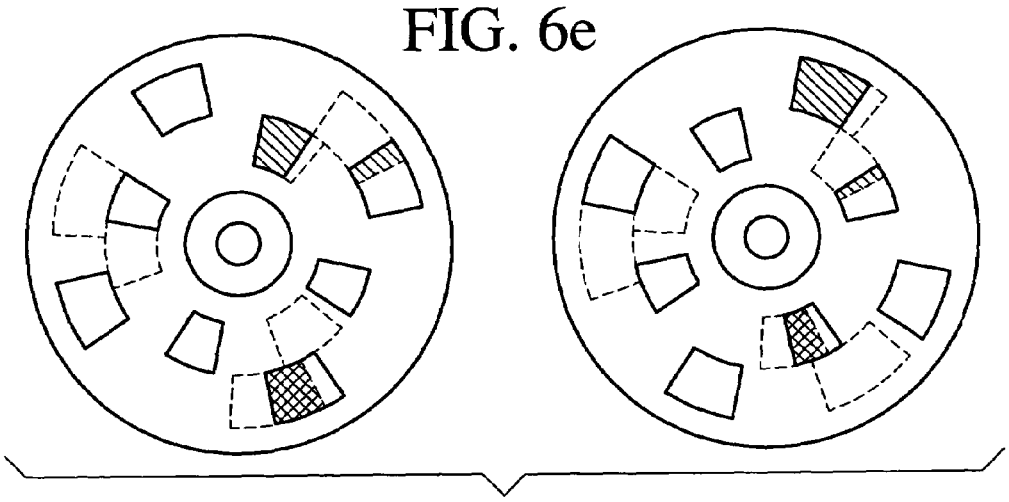
Figure 6G:
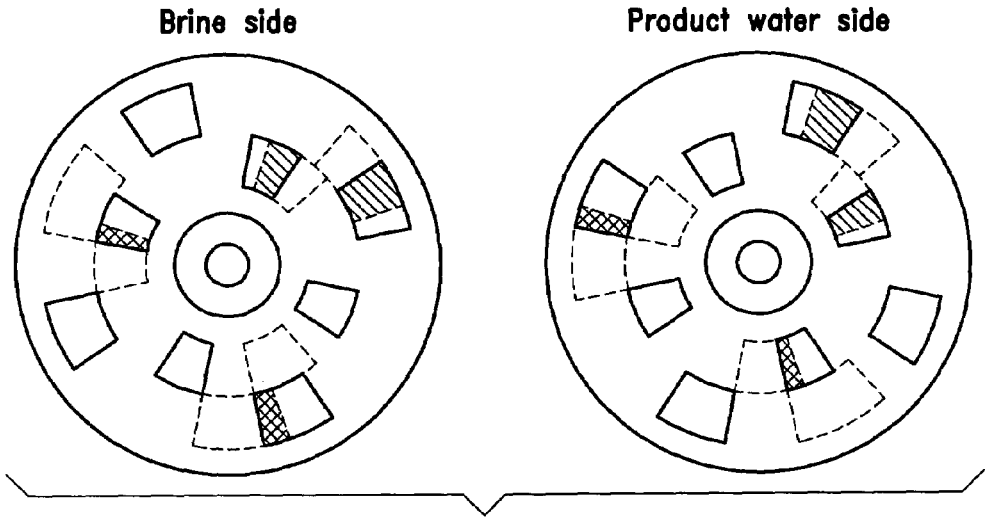
Figure 6H:
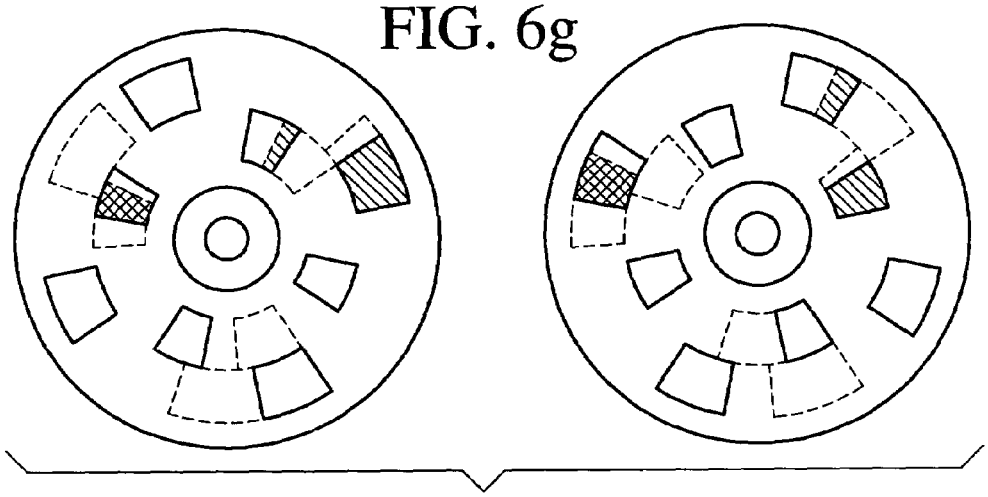
Figure 6I:
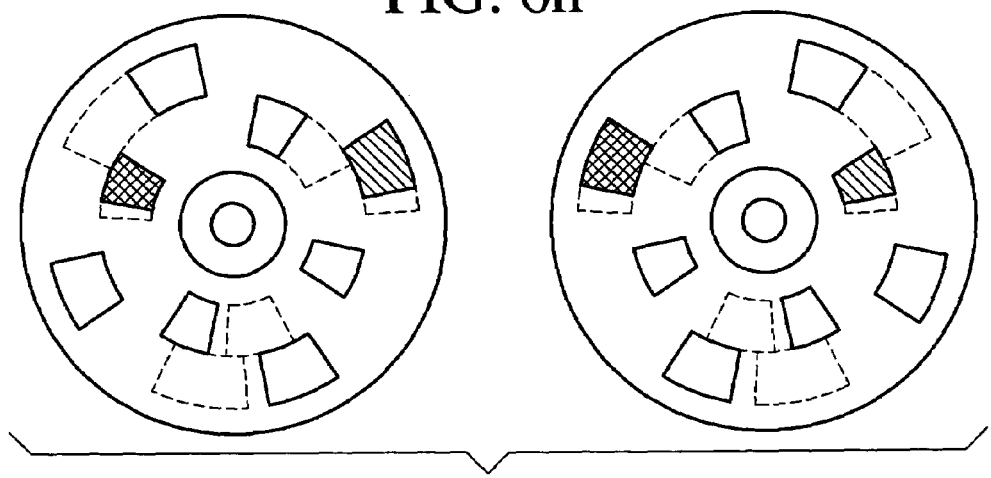
Figure 6J:
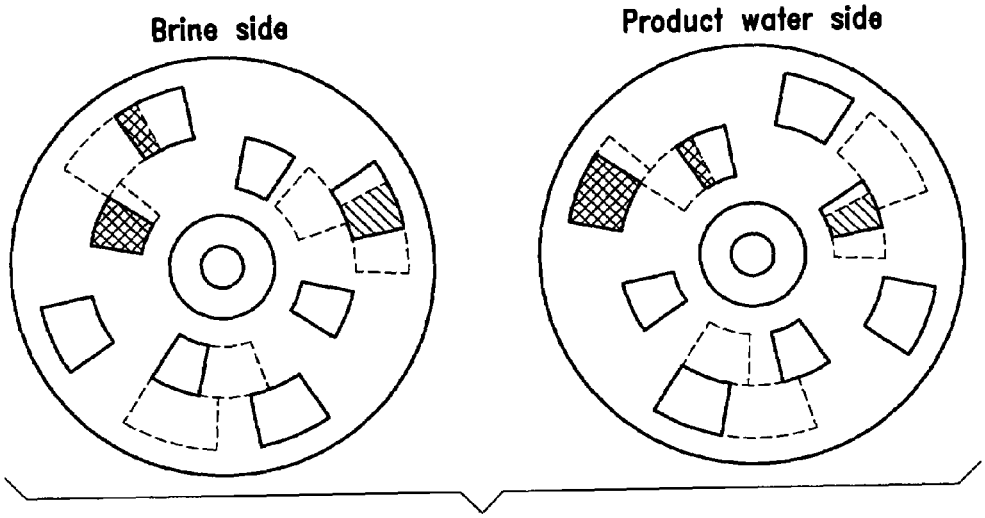
Figure 6K:
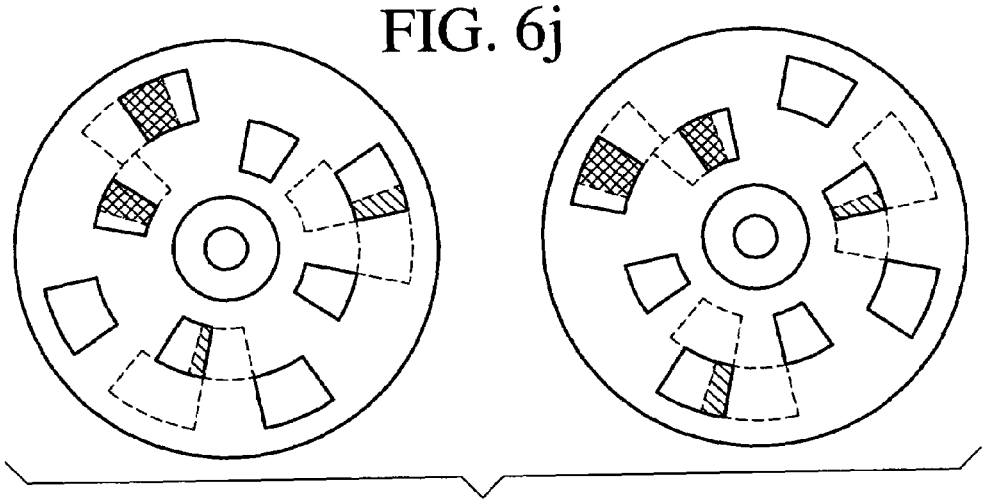
Figure 6L:
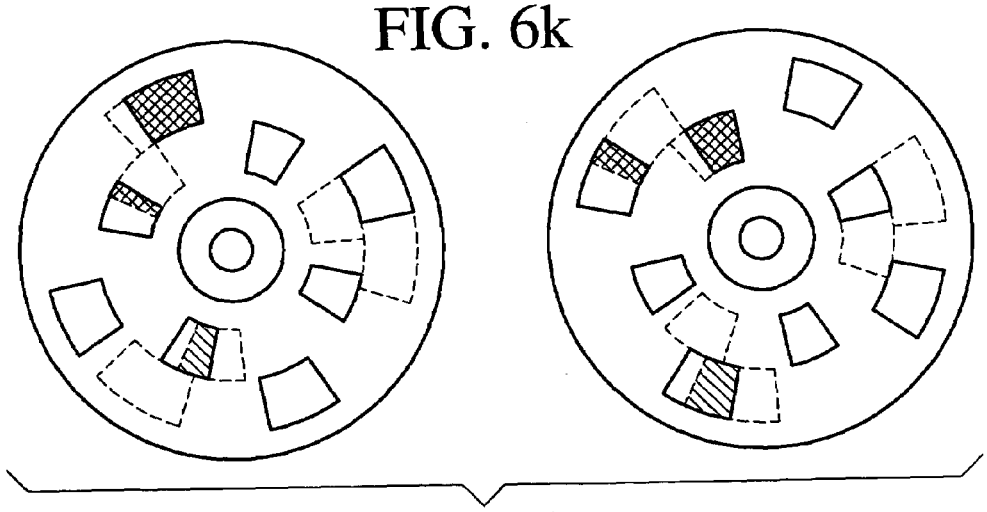
Figure 6M:
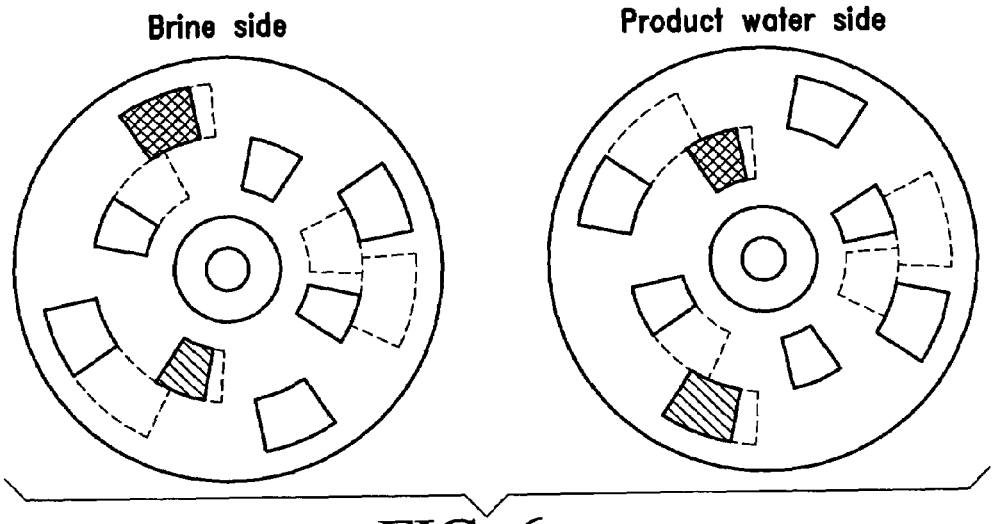
Figure 6N:
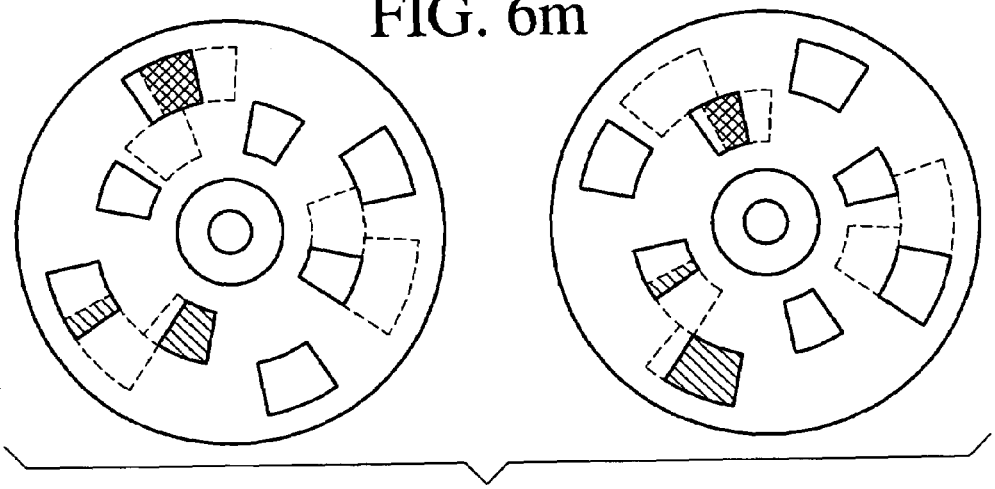
Figure 6O:
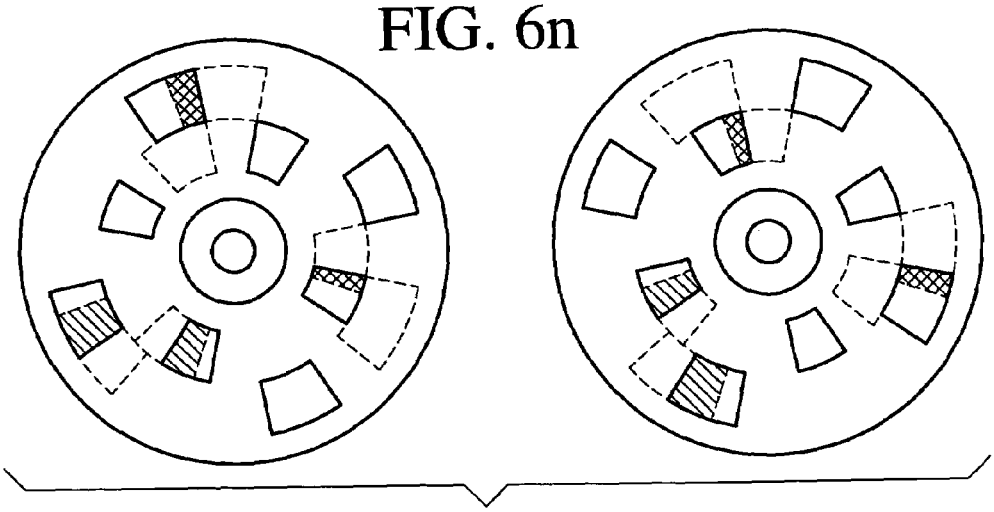
Figure 6P:
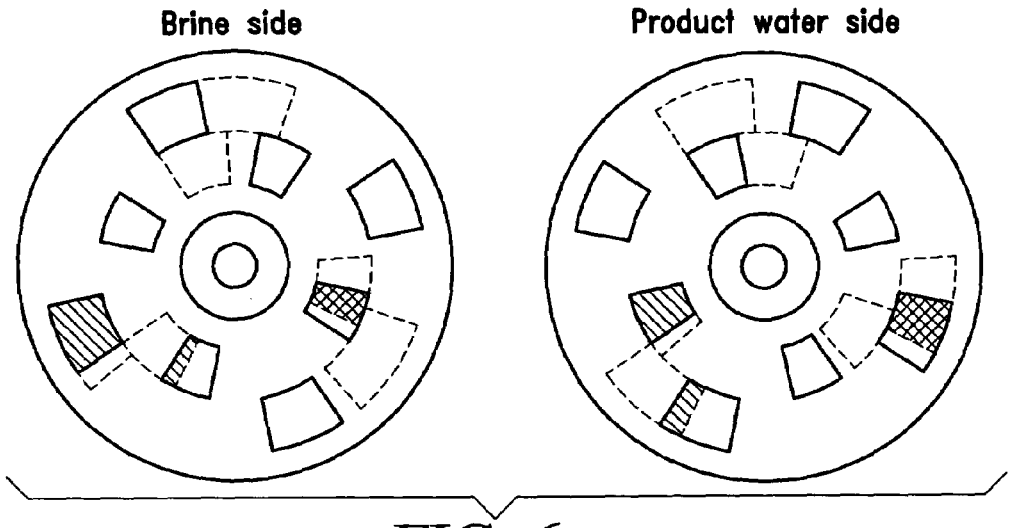
Figure 6Q:
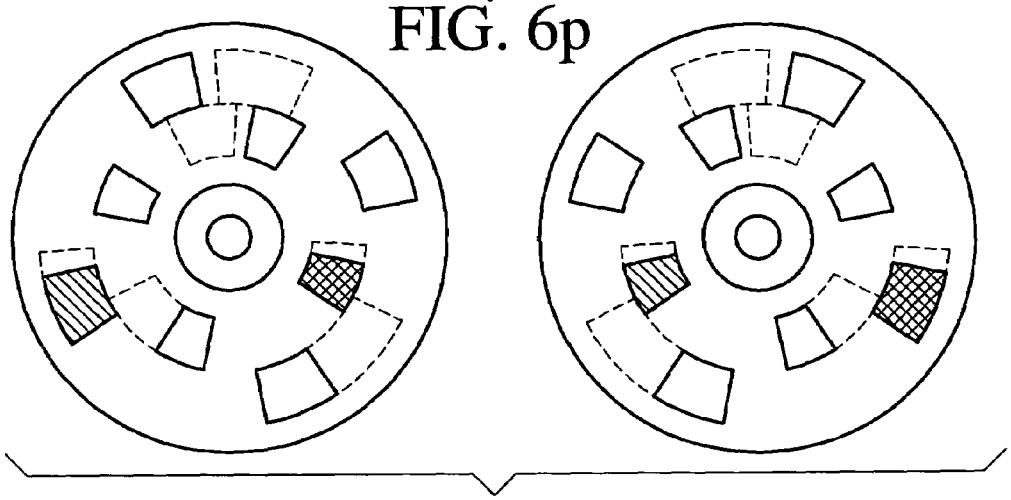
Figure 6R:
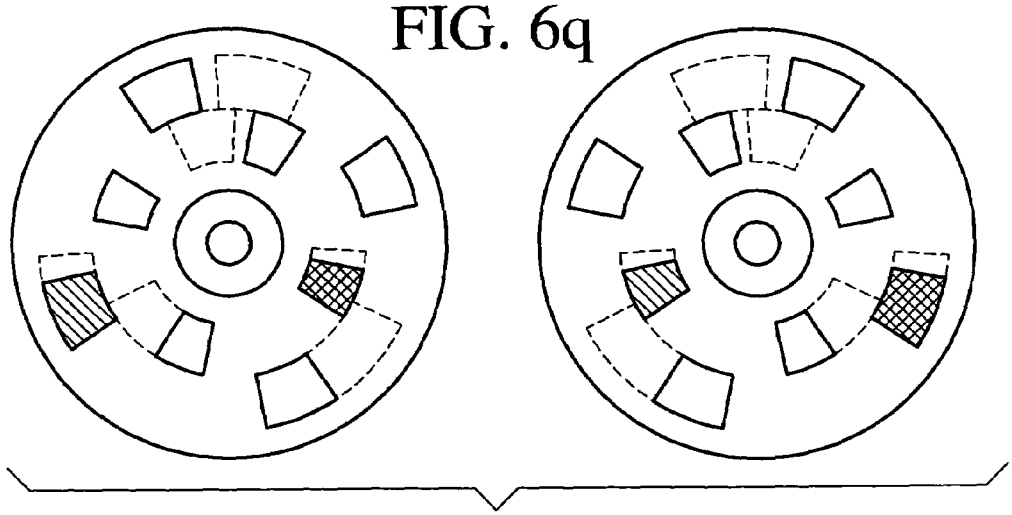

With respect to FIG. 6*a* through 6*r*, FIG. 6*a* illustrates an angle rotation is equal to 0° while FIG. 6*b* illustrates an angle of rotation equal to 7.5°. Further, FIG. 6*c* is an angle of rotation of 15°, FIG. 6*d* an angle rotation of 22.5° and FIG. 6*e* illustrates an angle of rotation of 30°. Further, FIG. 6*f* illustrates an angle of rotation of 37.5°, FIG. 6*g* illustrates an angle of rotation of 45° and FIG. 6*h* an angle of rotation of 52.5°. FIG. 6*i* illustrates an angle of rotation of 60° while FIG. 6*j* illustrates an angle of rotation of 67.5° and FIG. 6*k* illustrates an angle of rotation equal to 75°. In addition, FIG. 6*l* illustrates an angle of rotation of 82.5°, FIG. 6*n* an angle of rotation of 90° and FIG. 6*m* an angle of rotation equal to 97.5°. Further, FIG. 6*o* illustrates an angle of rotation of 105°, FIG. 6*p* an angle of rotation of 112.5°, FIG. 6*q* an angle of rotation equal to 120° (new cycle) and Figure r an angle of rotation equal to 240° equals to 360° (new cycle). In each of the above Figures, the exhaust liquid inlet/outlet side of the apparatus is illustrated on the left while the fresh feed liquid inlet/outlet side is illustrated on the right to illustrate the flow control sequence resulting from the rotation of the moveable disks with respect to the fixed disks.

While the invention has been described in connection with its preferred embodiment, it should be recognized that changes and modifications may be made therein without departing from the appended claims.

What is claimed is:

1. A pressure exchange apparatus for exchanging hydraulic pressure from a fluid stream at relatively high pressure to a fluid stream at relatively low pressure, said apparatus comprising:

a main section having two axially aligned ends and defining two internal longitudinal chambers, a piston disposed within each of said chambers in sealing engagement therewith and adapted to move longitudinally within said chamber, a pair of fluid distributors co-axially aligned with said main section with one of said fluid distributors fixed to each of said two axially aligned ends of said main section, and, each of said fluid distributors including an inlet port and an outlet port for directing a fluid stream into and out of one of said longitudinal chambers while sealingly separated from an adjacent chamber, a pair of dual disk controllers disposed co-axially with said fluid distributors and said main section with one of said pair of dual disk controllers between each of said fluid distributors and said main section, each of said dual disk controllers including a fixed disk and a disk holder having circumferentially arrayed openings aligned with an inlet and outlet port of the respective fluid distributor and a moveable disk having circumferentially arrayed openings sealingly sliding against and between said fixed disk and disk holder and adapted to rotate about its axis to bring one of its circumferentially arrayed openings into registration with one pair of matching said openings in said fixed disk and said disk holder to connect one of said ports with one of said longitudinal chambers to thereby move one of said pistons in one of said chambers to transfer pressure from a fluid stream at a relatively high pressure to a fluid stream at a relatively low pressure; and in which each of said fluid distributors is bolted to said disk holder and said disk holder is bolted to said main section.

2. A pressure exchange apparatus for exchanging hydraulic pressure from a fluid stream at relatively high pressure to a fluid stream at relatively low pressure, said apparatus comprising:

a main section having two axially aligned ends and defining two internal longitudinal chambers, a piston disposed within each of said chambers in sealing engagement therewith and adapted to move longitudinally within said chamber, a pair of fluid distributors co-axially aligned with said main section with one of said fluid distributors fixed to each of said two axially aligned ends of said main section, and, each of said fluid distributors including an inlet port and an outlet port for directing a fluid stream into and out of one of said longitudinal chambers while sealingly separated from an adjacent chamber, a pair of dual disk controllers disposed co-axially with said fluid distributors and said main section with one of said pair of dual disk controllers between each of said fluid distributors and said main section, each of said dual disk controllers including a fixed disk and a disk holder having circumferentially arrayed openings aligned with an inlet and outlet port of the respective fluid distributor and a moveable disk having circumferentially arrayed openings sealingly sliding against and between said fixed disk and disk holder and adapted to rotate about its axis to bring one of its circumferentially arrayed openings into registration with one pair of matching said openings in said fixed disk and said disk holder to connect one of said ports with one of said longitudinal chambers to thereby move one of said pistons in one of said chambers to transfer pressure from a fluid stream at a relatively high pressure to a fluid stream at a relatively low pressure; and in which said main section includes four internal longitudinal chambers, in which each of said fluid distributors is bolted to said disk holder and said disk holder is bolted to said main section, and which includes a passageway through said main section and a shaft extending through said passageway for synchronizing the movements of said moveable disks.

3. The pressure exchange apparatus according to claim 2 which includes a motor for rotating said shaft and means for controlling the speed of said motor.

4. A pressure exchange apparatus according to claim 2 having a first set of three radially arrayed apertures in said moveable disk and a second set of three radially arrayed apertures in said fixed disk and, in which the three apertures in said first set having identical open areas and the three apertures in said second set having identical open areas positioned equally apart.

5. A pressure exchange apparatus for exchanging hydraulic pressure from a fluid stream at relatively high pressure to a fluid stream at relatively low pressure, said apparatus comprising:

a middle main section defining two internal chambers;

two flow control assemblies bolted to said middle main section of said pressure exchange apparatus;

one of said flow control assemblies regulating flow of the high pressure fluid stream entering and exiting said middle main section and the other of said two flow control assemblies regulating the flow of a low pressure stream entering and exiting said middle main section; and two fluid distributor assemblies fixed to said flow control assemblies so that each flow control assembly is disposed between one of said fluid distributors and said middle main section and wherein one of said fluid distributor assemblies is bolted on said flow control assembly and facilitates admission and discharge of exhaust fluid and wherein the other fluid distributor assembly is bolted on said fluid flow control assembly for admission and discharge of low pressure fluid; and one circular moveable disk, having two ultra-smooth finished flat surfaces disposed in each of said fluid control assemblies to rotate against two fixed ultra-smooth finished flat surfaces wherein one of said circular disks is disposed to rotate against two fixed flat surfaces one of which is on the inside of a disk holder structure facing outwards on the other side of the end which is bolted to the middle main section of the pressure exchanger and the other said fixed flat surface is on the inside of a fixed disk which is housed and prevented from rotation inside said disk holder.

6. A fluid distributor and flow control mechanism for controlling a flow of fluid streams in a pressure exchange apparatus for exchanging hydraulic pressure from an exhaust fluid stream at relatively high pressure to a fresh fluid stream at relatively low pressure, said mechanism comprising:

a middle main structure having two ends and two flow controller assemblies each of which has an inner and a outer end with one of said flow control assemblies bolted on each of said two ends of said middle main structure and wherein one of said two flow control assemblies regulates the flow of an exhaust fluid stream entering and exiting the middle main structure on one end thereof and wherein the other of said two flow control assemblies regulates a flow of a fresh stream entering and exiting said middle main structure at the other end of said middle main structure;

two fluid distributor assemblies each of which has an inner end and an outer end with one of said two fluid distributor assemblies bolted on said other end of each of said flow controller assemblies so that each of said flow controller assemblies are disposed between one of said fluid distributor assemblies and said middle main structure; and wherein one of said fluid distributor assemblies that is bolted to one of said flow controller assemblies facilitates admission and discharge of exhaust fluid and wherein the other of said distributor assemblies bolted on said second of said flow controller assemblies facilitates admission and discharge of fresh fluid; and wherein each of said flow control assemblies includes a disk holder structure facing outward on the other side of the end that is bolted to the middle main structure, a fixed disk with a flat surface fixed in said disk holder and a circular moveable disk having two opposite flat surfaces and adapted to rotate with respect to said fixed disk.

7. A fluid distributor and flow control mechanism according to claim 6 wherein said moveable disk and said fixed disk each include a plurality of apertures and wherein the apertures in said moveable disk are centered to correspond with the apertures in said fixed disk for fresh fluid and similarly the apertures in the moveable disk on the opposite side of said middle main structure are centered to correspond with the apertures on the fixed disk on the opposite side of said middle main structure for exhaust fluid.

* * * * *